US007528781B2

(12) United States Patent
Lin et al.

(10) Patent No.: US 7,528,781 B2
(45) Date of Patent: May 5, 2009

(54) CIRCULARLY POLARIZED ANTENNA

(75) Inventors: Hsiao-Cheng Lin, Hsin-Tien (TW); Chih-Jen Hsiao, Hsin-Tien (TW); Tsung-Wen Chiu, Hsin-Tien (TW); Fu-Ren Hsiao, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/008,935

(22) Filed: Jan. 15, 2008

(65) Prior Publication Data

US 2008/0174495 A1 Jul. 24, 2008

(30) Foreign Application Priority Data

Jan. 19, 2007 (TW) ..... 96102097 A

(51) Int. Cl.
*H01Q 1/38* (2006.01)
*H01Q 5/00* (2006.01)
*H01Q 9/04* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 6,054,953 A * 4/2000 Lindmark ..... 343/700 MS
2004/0066338 A1 * 4/2004 Chen et al. ..... 343/700 MS
2005/0057396 A1 * 3/2005 Boyanov ..... 343/700 MS
2006/0097921 A1 * 5/2006 Luk et al. ..... 343/700 MS
2007/0296635 A1 * 12/2007 Popugaev et al. ..... 343/700 MS

* cited by examiner

*Primary Examiner*—Rexford Barnie
*Assistant Examiner*—Dylan White
(74) *Attorney, Agent, or Firm*—William E. Pelton, Esq.; Cooper & Dunham LLP

(57) ABSTRACT

A circularly polarized antenna has a dielectric substrate, a feeding member, a coupling member, a ground plane, a support and a radiating patch. The feeding member is mounted on the dielectric substrate and has a first conductor, a second conductor, a connecting conductor and a third conductor. The second conductor is connected to the first conductor. The connecting conductor is connected to the first conductor. The third conductor is connected to the connecting conductor and is parallel to the second conductor. The coupling member is connected to the feeding member. The ground plane is mounted on the dielectric substrate. The support is mounted on the dielectric substrate. The radiating member is mounted on the support. The circularly polarized antenna generates the circularly polarized radiation being parallel to the ground plane so that portable wireless products with the circularly polarized antenna have an excellent gain.

8 Claims, 10 Drawing Sheets

CIRCULARLY POLARIZED ANTENNA

BACKGROUND OF THE INVENTION

1. Field of the Invention

The present invention relates to an antenna, and more particularly to a circularly polarized antenna that a dielectric substrate, a ground plane and a radiating patch. The circularly polarized antenna set in a portable wireless product has a maximum gain when the portable wireless product is used and held uprightly.

2. Description of Related Art

Circularly polarized signals may be transmitted through ionosphere so that military satellites use circularly polarized antennas to transmit circularly polarized signal. Since the global positioning system (GPS) of satellites is recently available for the public, GPS products are equipped with circularly polarized antennas. Furthermore, circular polarized antennas have an excellent advantage that prevents multi-signal transmission path interference so that circularly polarized antennas are also used in general wireless products such as cellular phones and wireless internet routers.

With reference to FIG. 1, a conventional circularly polarized antenna comprises a substrate (1), a ground plane and a radiating patch.

The substrate (1) has a front surface and a rear surface. The ground plane is mounted on the rear surface. The radiating patch is rectangular, mounted on the front surface of the substrate (1) and has two opposite bevel corners (11), a feeding point (10) and two current paths (P1, P2). The currents along the current paths (P1, P2) stimulate two operating modes being perpendicular to each other to provide circularly polarized signals.

With reference to FIG. 2, another circularly polarized antenna comprises a substrate (2), a ground plane, a connecting member (22) and a radiating patch (20). The substrate (2) has a front surface and a rear surface. The ground plane is mounted on the rear surface of the substrate (2). The connecting member (22) is branched, is mounted on the front surface of the substrate (2) and has a feeding point (21) and two branches. The feeding point (21) is connected to a printed circuit board from a wireless product. Each branch has a feeding end (23). The radiating patch (20) is connected to the feeding ends (23) of the connecting member (22) and is suspended on the front surface of the substrate (2). The radiating patch (20) cooperates with the connecting member (22) to provide two operating modes to transmit circularly polarized signals.

However, the two aforementioned conventional circularly polarized antennas are set uprightly with the ground plane and radiating patch perpendicular to the ground when mounted on portable devices such as cellular phones or GPS devices. Without setting the ground plane and radiating patch parallel to the ground, signal transmission efficiency of the conventional circularly polarized antennas is greatly lowered.

To overcome the shortcomings, the present invention provides a circularly polarized antenna to mitigate or obviate the aforementioned problems.

SUMMARY OF THE INVENTION

The main objective of the invention is to provide a circularly polarized antenna that a dielectric substrate, a ground plane and a radiating patch. The circularly polarized antenna set in a portable wireless product has a maximum gain when the portable wireless product is used and held uprightly.

A circularly polarized antenna in accordance with the present invention has a dielectric substrate, a feeding member, a coupling member, a ground plane, a support and a radiating patch. The feeding member is mounted on the dielectric substrate and has a first conductor, a second conductor, a connecting conductor and a third conductor. The second conductor is connected to the first conductor. The connecting conductor is connected to the first conductor. The third conductor is connected to the connecting conductor and is parallel to the second conductor. The coupling member is connected to the feeding member. The ground plane is mounted on the dielectric substrate. The support is mounted on the dielectric substrate. The radiating member is mounted on the support. The circularly polarized antenna generates the circularly polarized radiation being parallel to the ground plane so that portable wireless products with the circularly polarized antenna have an excellent gain.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
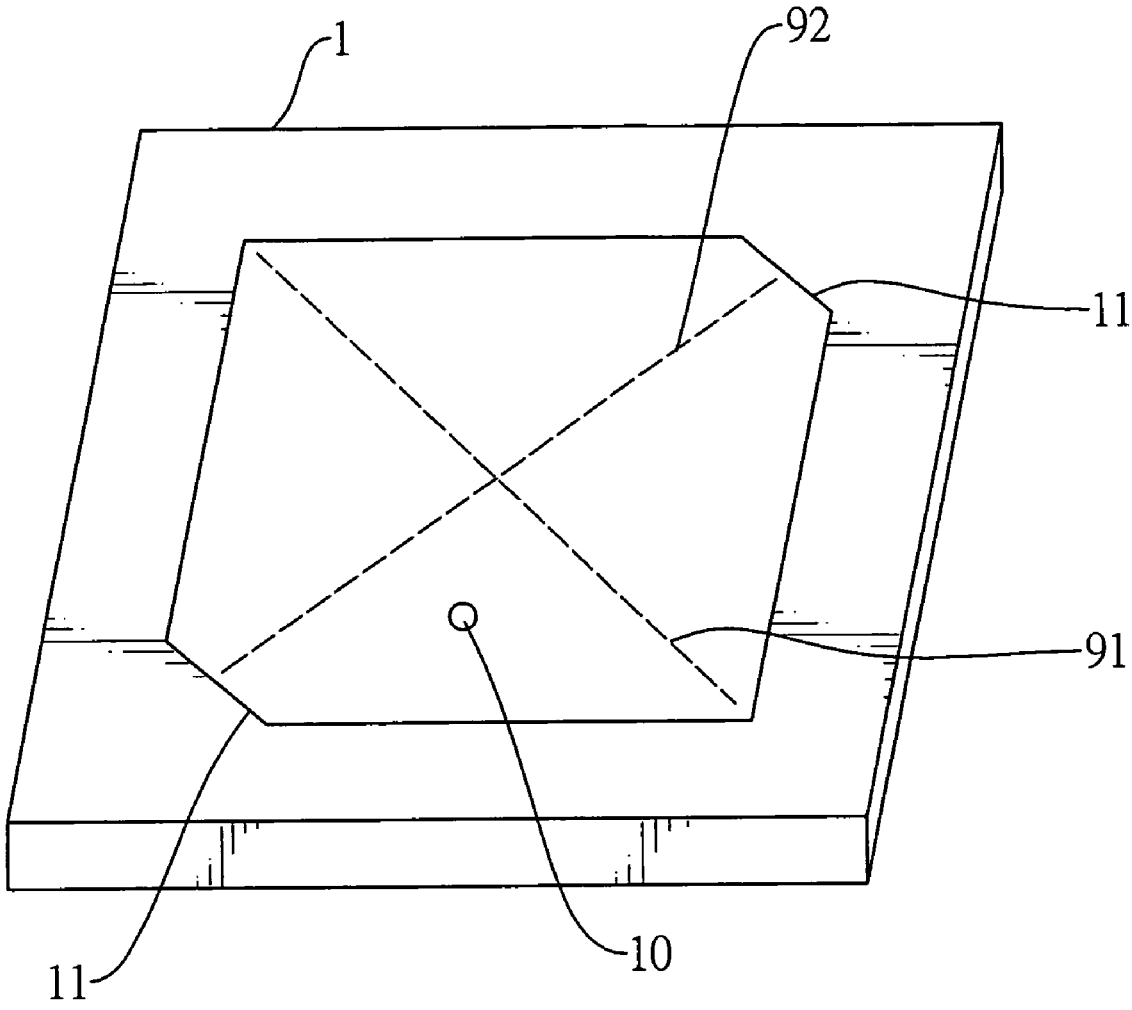
FIG.1 PRIOR ART
FIG. 1 is a perspective view of a conventional circularly polarized antenna in accordance with the prior art.
Figure 2:
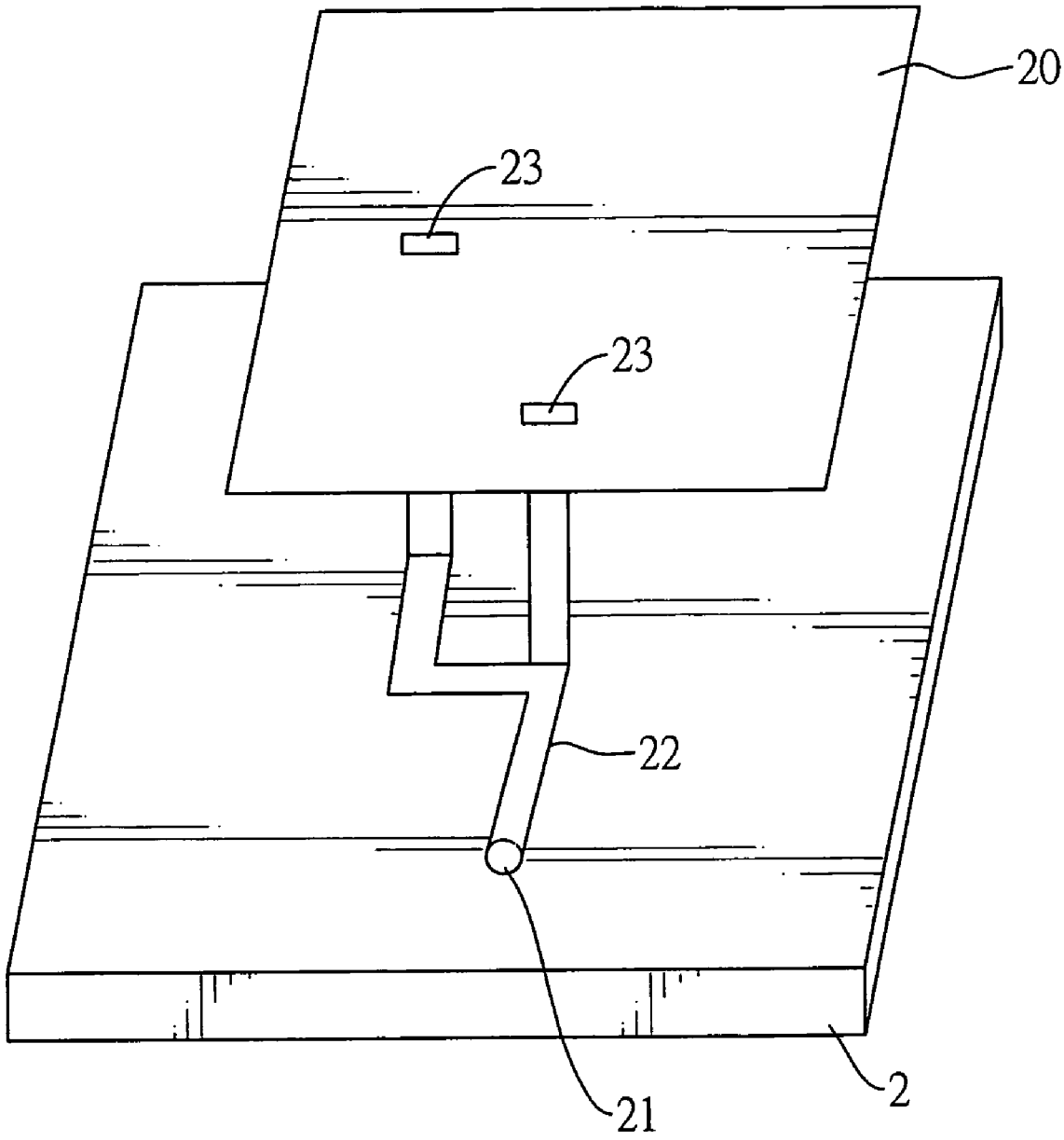
FIG.2 PRIOR ART
FIG. 2 is a perspective view of another conventional circularly polarized antenna in accordance with the prior art.
Figure 3:
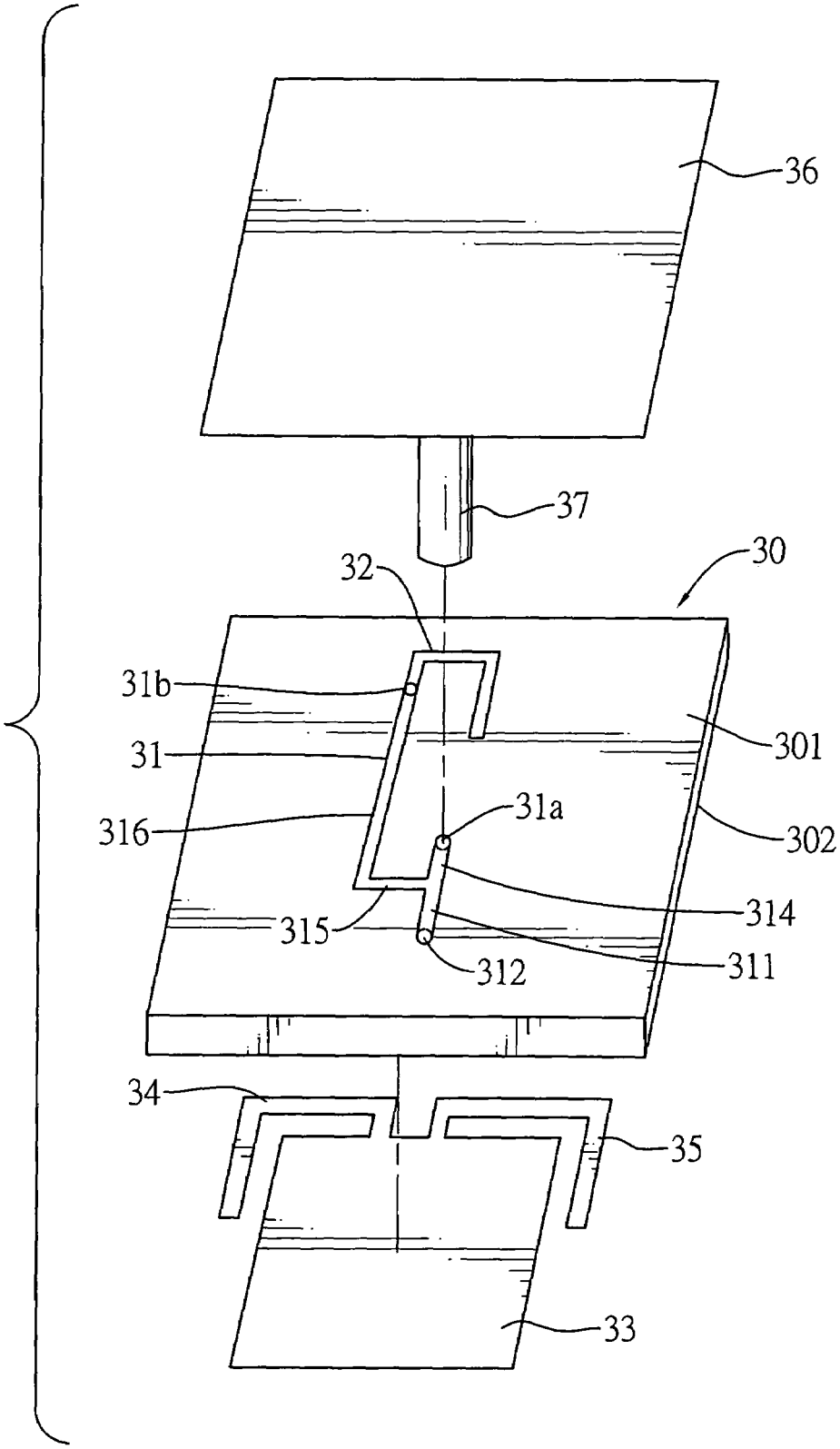
FIG. 3 is an exploded perspective view of a first embodiment of a circularly polarized antenna in accordance with the present invention.

With reference to FIG. 3, a first embodiment of a circularly polarized antenna in accordance with the present invention comprises a dielectric substrate (30), a feeding member (31), a coupling member (32), a ground plane (33), a support (37) and a radiating patch (36).

The dielectric substrate (30) may be made of microwave dielectric such as microwave ceramics and has a front surface (301) and a rear surface (302).

The feeding member (31) is made of metal, is mounted on the front surface (301) of the dielectric substrate (30) and has a first conductor (311), a feeding point (312), a second conductor (314), a first signal point (31*a*), a connecting conductor (315), a third conductor (316) and a second signal point (31*b*).

The first conductor (311) is longitudinal, is mounted on the front surface (301) of the dielectric substrate (30) and has a proximal end and a distal end.

The feeding point (312) is formed on the distal end of the first conductor (311). High frequency signals are fed into the feeding member (31) through the feeding point (312).

The second conductor (314) is longitudinal, is connected to the proximal end of the first conductor (311), is preferably formed on and protrudes longitudinally and directly from the proximal end of the first conductor (311) and has a first end and a second end. The first end of the second conductor (314) is connected directly to the proximal end of the first conductor (311).

The first signal point (31*a*) is formed on the second end of the second conductor (314). High frequency signals from the feeding point (312) are transmitted along the first conductor (311) and the second conductor (314) to the first signal point (31*a*).

The connecting conductor (315) is formed on and protrudes perpendicularly from the proximal end of the first conductor (311) and has two connecting ends. One connecting end is connected to the proximal end of the first conductor (311).

The third conductor (316) is longitudinal, is formed on and protrudes perpendicularly from the other connecting end of the connecting conductor (315), is parallel to the second conductor (314) and has a first end and a second end. The first end of the third conductor (316) is connected to the connecting end of the connecting conductor (315). The length of the third conductor (316) is larger than a length of the second conductor (314). The length difference between the second and third conductors (314, 316) generates a current phase difference.

The second signal point (31*b*) is formed on the second end of the second branch conductor (316). High frequency signals from the feeding point (312) are transmitted along the first conductor (311) and the third conductor (316) to the second signal point (31*b*).

The coupling member (32) is made of metal, is mounted on the front surface (301) of the dielectric substrate (30) and is connected to and protrudes from the second signal point (31*b*) of the feeding member (31). High frequency signals from the second signal point (31*b*) are transmitted along the coupling member (32).

Figure 5A:
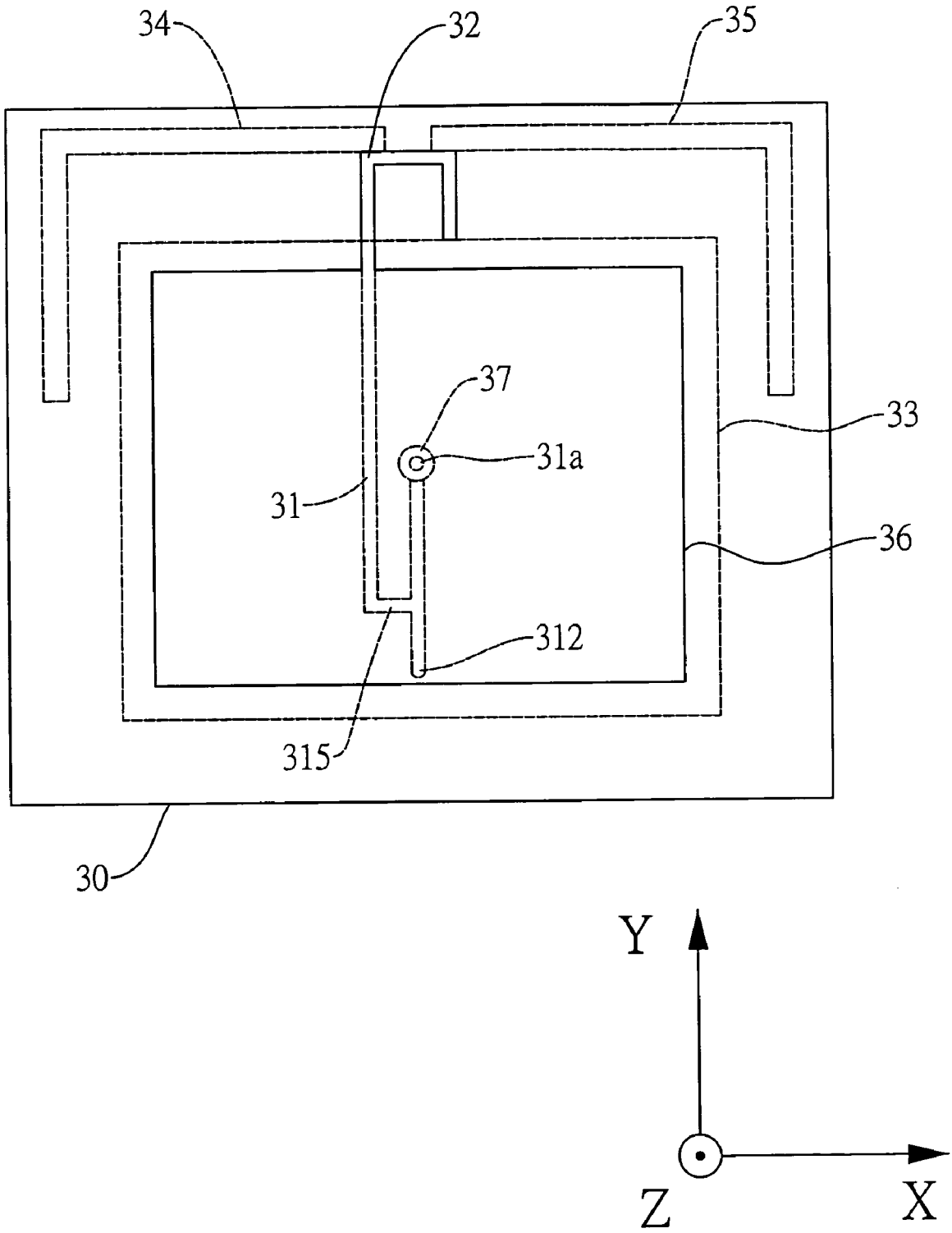
FIG. 5A is a front view of the circularly polarized antenna set with a three-dimensional (3D) coordinate, wherein Y-axis is perpendicularly to the ground and X-axis and Z-axis are parallel to the ground.

With further reference to FIG. 5A, the ground plane (33) is rectangular and is mounted on the rear surface (302) of the dielectric substrate (30). The ground plane (33) entirely overlaps the feeding member (31). In other words, the feeding member (31) is surrounded and enclosed by an outline of the ground plane (33). The ground plane (33) has four edges, four corners and two extension conductors (34, 35). The extension conductors (34, 35) are L-shaped, are formed on and protrude from one edge of the ground plane (33) and extend respectively along two adjacent corners. The extension conductors (34, 35) are symmetrical relative to a symmetrical line along which the coupling member (32) lies. Each extension conductor (34, 35) has a connecting end connected to the ground plane (33) and located adjacent to the coupling member (32). The extension conductors (34, 35) cooperate with the coupling member (32) by capacitive coupling means to stimulate a first linearly polarized radiation being parallel to the ground plane (33).

The support (37) is longitudinal, is made of metal, may be made of copper, is mounted perpendicularly on the front surface of the dielectric substrate (30), is connected to the first signal point (31*a*) of the feeding member (31) and has a rear end and a front end. The rear end is mounted on front surface of the dielectric substrate (30).

The radiating patch (36) may be rectangular or circular, is mounted on the front end of the support (37), is connected to the feeding member (31) through the support (37) and is parallel to the ground plane (33). Signals from the first signal point (31*a*) to the radiating patch (36) generates second linearly polarized radiation being perpendicular to the ground plane (33). The first linearly polarized radiation and second linearly polarized radiation cooperate to define circularly polarized radiation being parallel to the ground plane (33).

Figure 4:
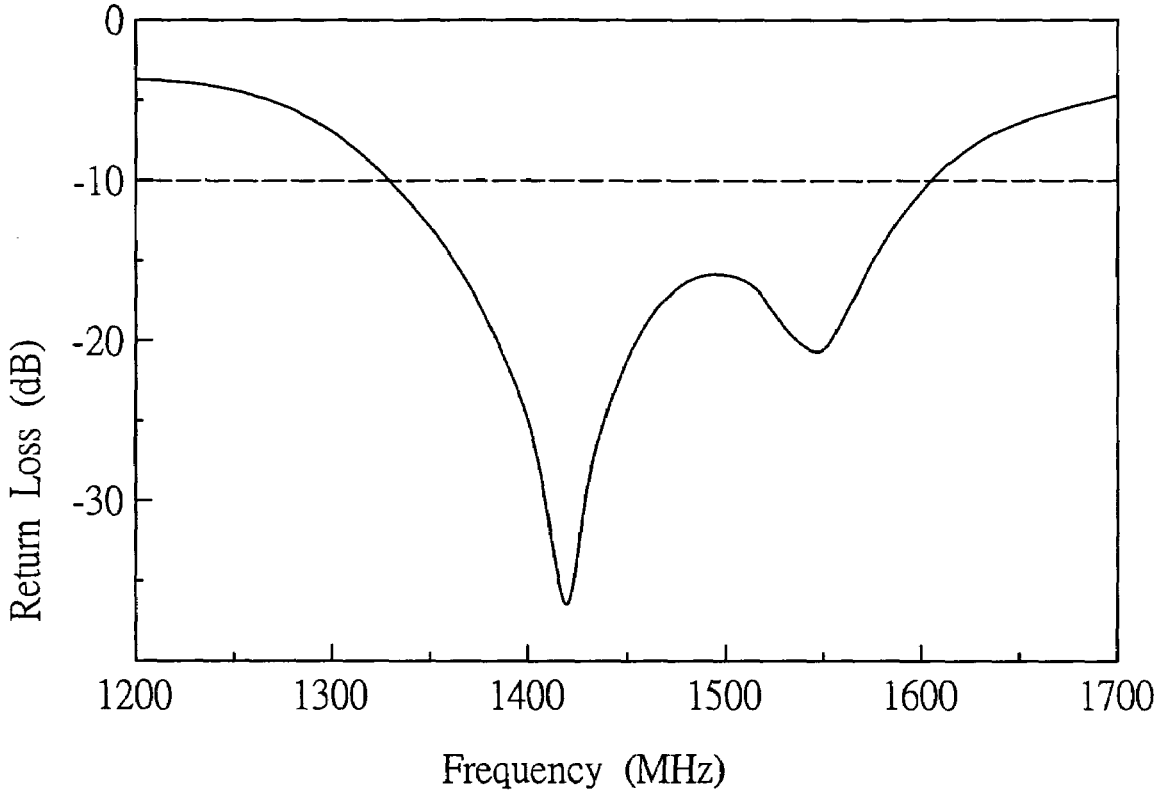
FIG. 4 is a diagram of return loss vs. frequency of the circularly polarized antenna in accordance in FIG. 3, wherein the central frequency of an operating mode is 1551 MHz and an impedance bandwidth under the voltage standing wave ratio (VSWR) of 2:1 is 275 MHz matching the global positioning system (GPS) bandwidth.

With further reference to FIG. 4, an operating mode of the circularly polarized antenna has a central frequency of 1551 MHz. An impedance bandwidth under voltage standing wave ratio (VSWR) of 2:1 achieves 275 MHz, which matches the global positioning system (GPS) bandwidth.

Figure 5B:
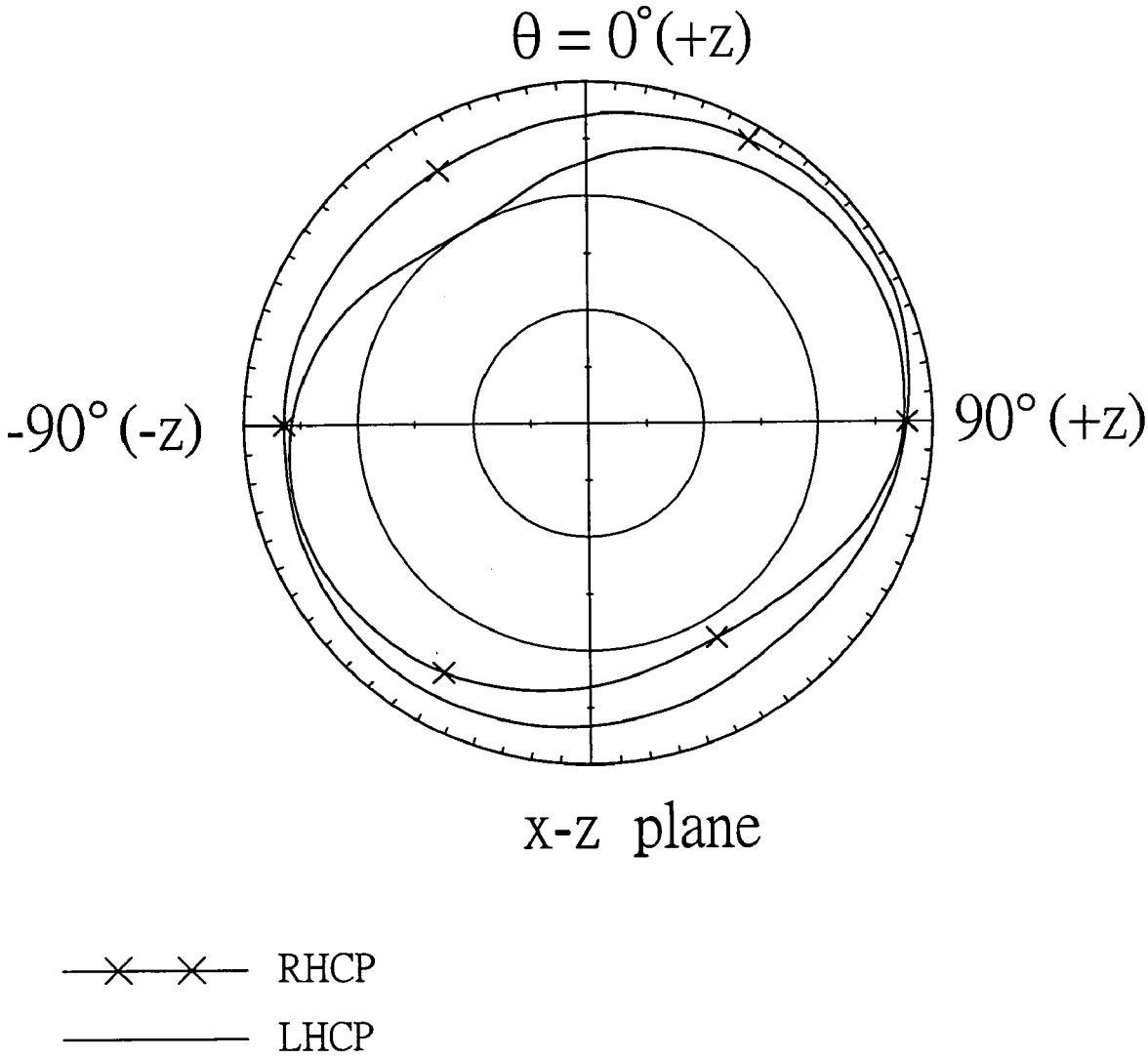
FIG. 5B is a diagram of the right hand circular polarization (RHCP) radiation pattern and left hand polarization (LHCP) radiation pattern of the circularly polarized antenna in the X-Z plane of the 3D coordinate in FIG. 5A.
Figure 5C:
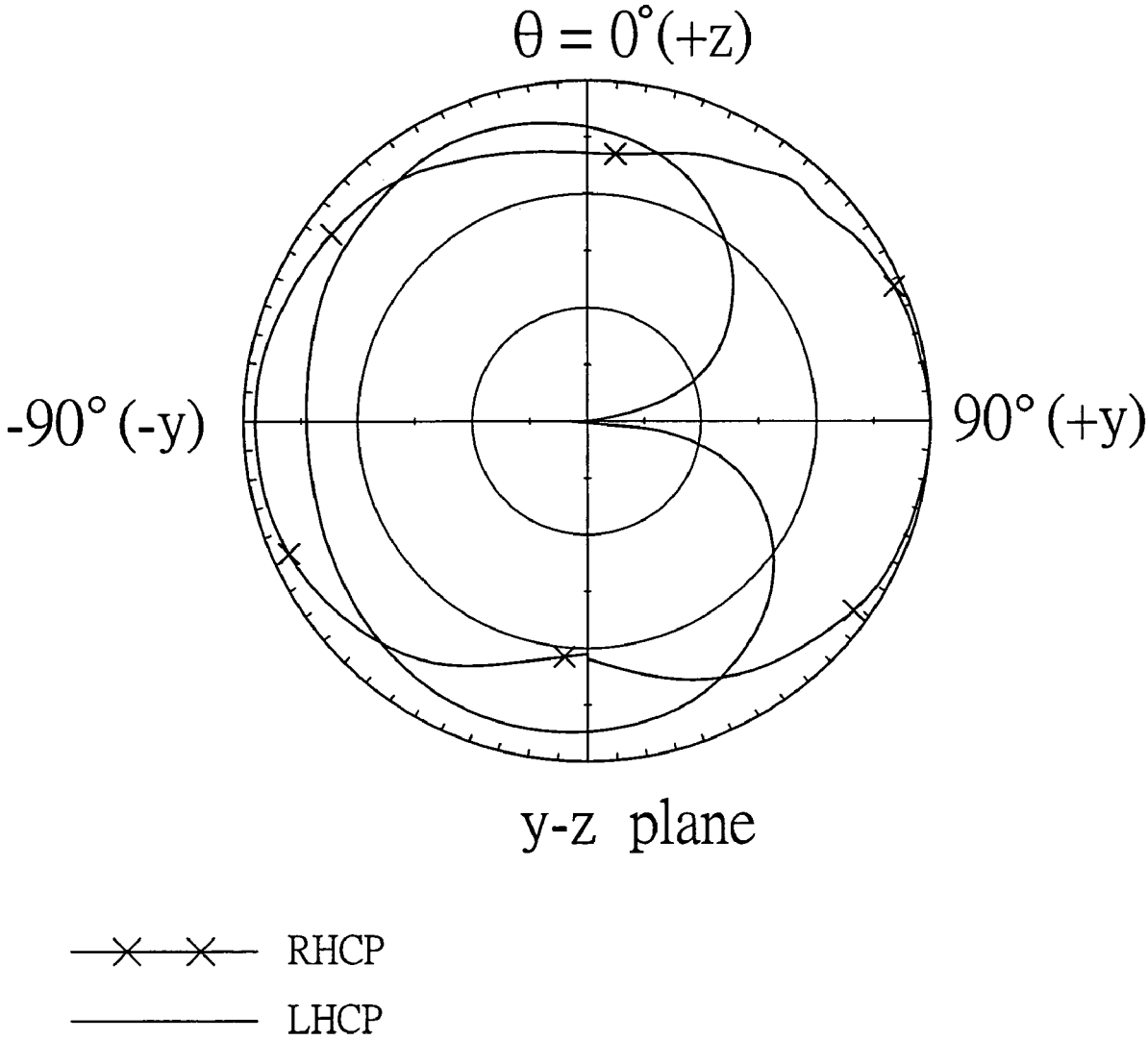
FIG. 5C is a diagram of the RHCP and LHCP radiation patterns of the circularly polarized antenna in the Y-Z plane of the 3D coordinate in FIG. 5A.
Figure 5D:
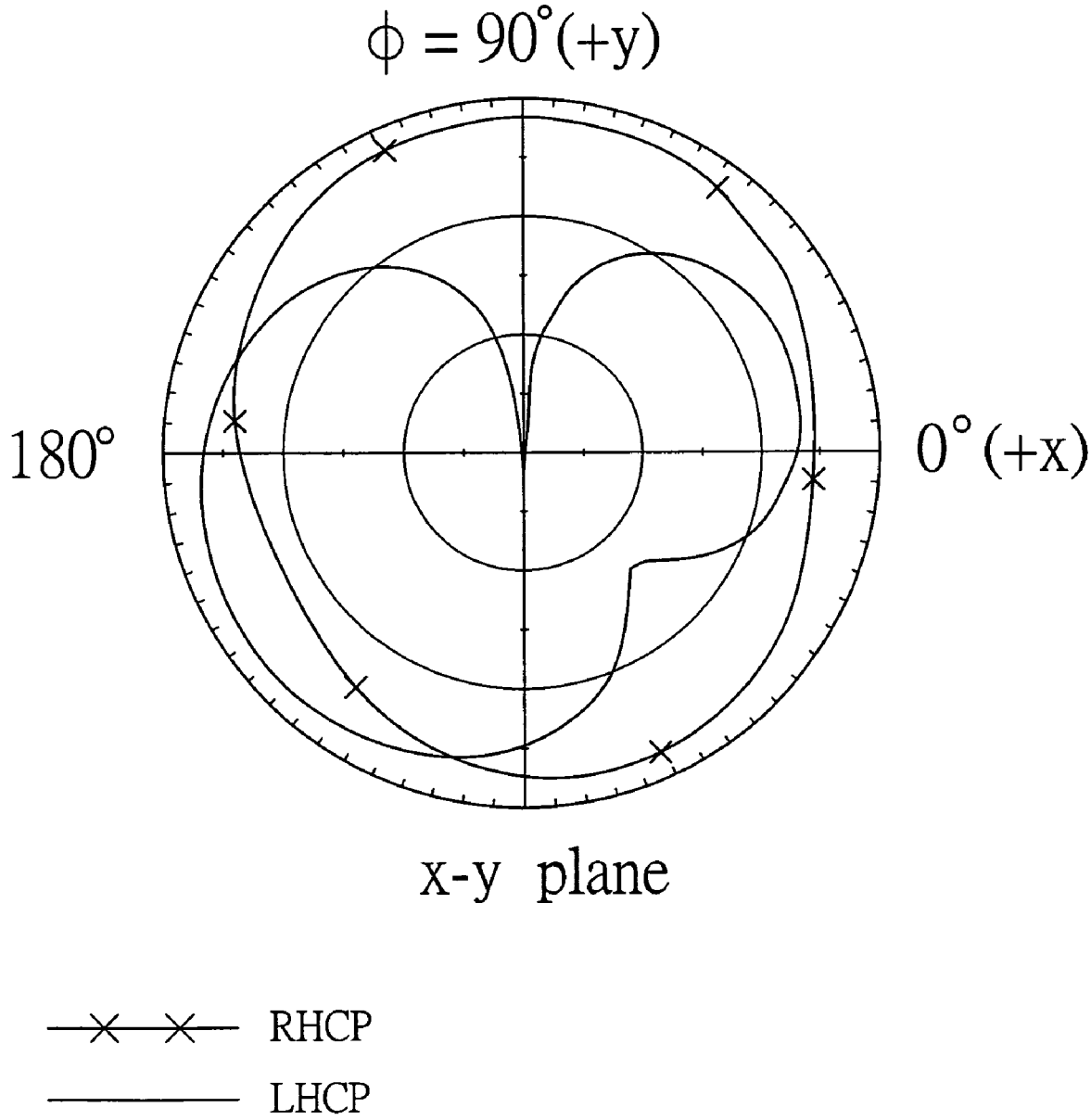
FIG. 5D is a diagram of the RHCP and LHCP radiation patterns of the circularly polarized antenna in the X-Y plane of the 3D coordinate in FIG. 5A.

With further reference to FIGS. 5B-5D, right hand circular polarization (RHCP) and left hand circular polarization (LHCP) radiation patterns in X-Y, Y-Z, X-Z planes of a three-dimensional coordinate resulted from the measurement under 1575 MHz of the circularly polarized antenna are illustrated. The radiation patterns show that RHCP is a main polarization of the circularly polarized antenna. Furthermore, the radiation patterns in the X-Y and Y-Z planes show that the maximum radiation direction is +Y direction being parallel the ground plane (33).

Figure 6:
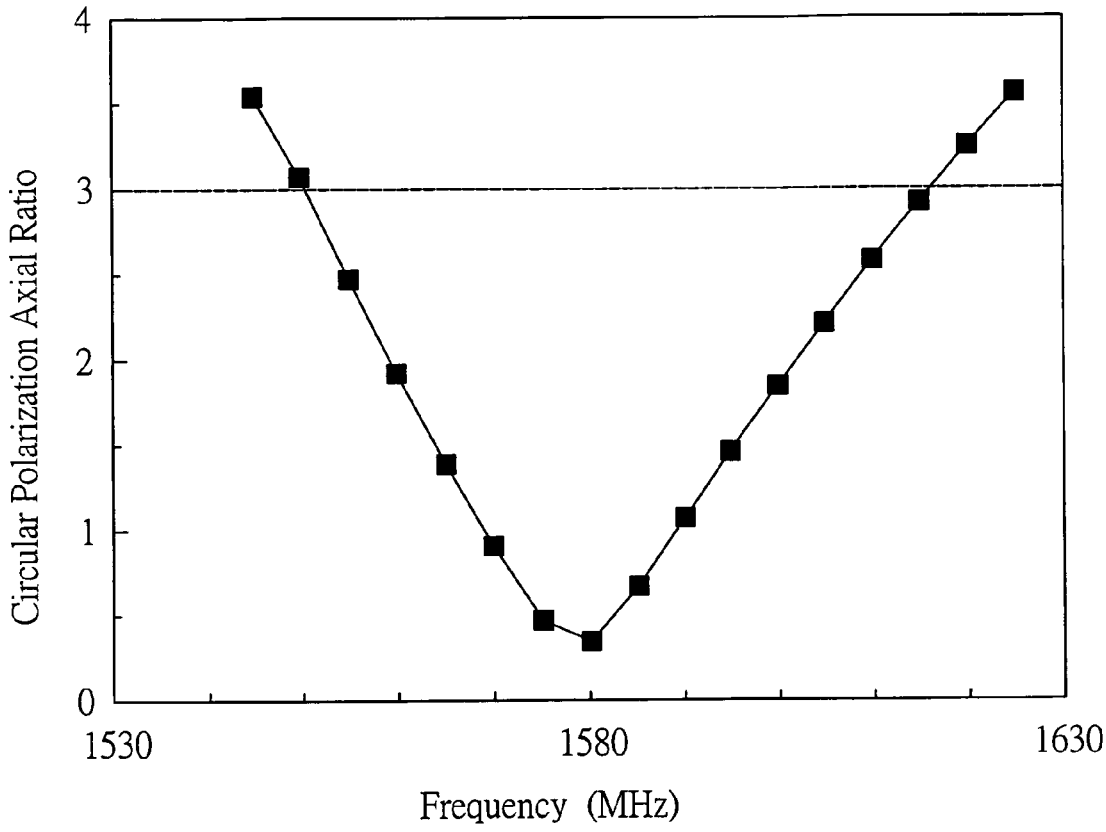
FIG. 6 is a diagram of circularly polarized axial ratio vs. frequency of the X-Y plane in FIG. 5A, wherein the central frequency of circularly polarized mode is 1582 MH and a circularly polarized axial ratio bandwidth under 3 dB is 70 MHz matching the GPS bandwidth.

With further reference to FIG. 6, a circularly polarized mode of the circularly polarized antenna in the X-Y plane has a central frequency of 1582 MHz. A circularly polarized axial ratio bandwidth under 3 dB achieves 70 MHz, which matches the GPS bandwidth.

Figure 7:
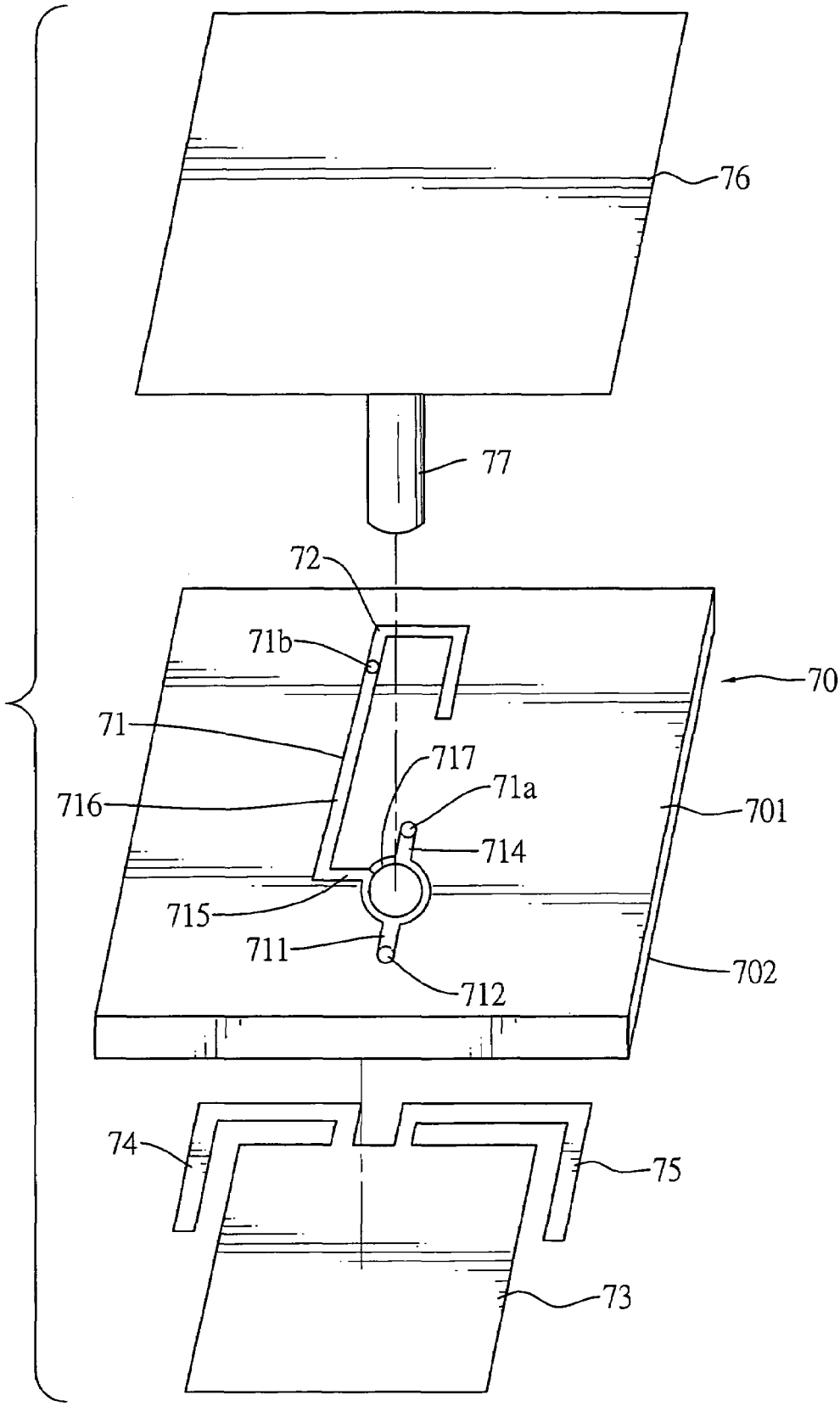
FIG. 7 is an exploded perspective view of a second embodiment of a circularly polarized antenna in accordance with the present invention.

With further reference to FIG. 7, a second embodiment of a circularly polarized antenna in accordance with the present invention is similar to the first embodiment and has a dielectric substrate (70), a feeding member (71), a coupling member (72), a ground plane (73), a support (77) and a radiating patch (76).

The dielectric substrate (70) is similar to that of the first embodiment and has a front surface (701) and a rear surface (702).

The feeding member (71) is similar to that of the first embodiment, is a Wilkinson power divider and has a first conductor (711), a feeding point (712), a second conductor (714), a first signal point (71*a*), a connecting conductor (715), a third conductor (716) and a second signal point (71*b*) and further has a looped conductor and a resistor (717). The second conductor (714) is connected to the first conductor (711) through the looped conductor. The resistor (717) is mounted on the looped conductor between the second conductor (714) and the connecting conductor (715).

The coupling member (72) is similar to that of the first embodiment.

The ground plane (73) is similar to that of the first embodiment and has two extension conductors (74, 75).

The support (77) and radiating patch (76) are also similar to those of the first embodiment.

The circularly polarized antenna generates the circularly polarized radiation being parallel to the ground plane (33, 73) so that the circularly polarized antenna acquire the best gain when the ground plane (33, 73) stand uprightly relative to the ground. Due to portable wireless products such as cellular phones and GPS devices are designed with thin thicknesses, the circularly polarized antenna is assembled to such portable wireless products with the ground plane (33, 73) being parallel to front and rear surfaces of the portable wireless products. When a user uprightly holds and uses a portable wireless product relative to the ground, the circularly polarized antenna has the best gain. Therefore, the circularly polarized antenna greatly facilitates and improves the portable wireless products when compared to conventional antennas.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A circularly polarized antenna comprising:

a dielectric substrate having a front surface and a rear surface;

a feeding member mounted on the front surface of the dielectric substrate and having a first conductor being longitudinal, mounted on the front surface of the dielectric substrate and having a proximal end and a distal end;

a feeding point formed on the distal end of the first conductor;

a second conductor being longitudinal, connected to the first conductor and having a first end connected to the proximal end of the first conductor; and a second end;

a first signal point formed on the second end of the second conductor;

a connecting conductor formed on and protrudes perpendicularly from the proximal end of the first conductor, having two connecting ends and one connecting end connected to the proximal end of the first conductor;

a third conductor being longitudinal, formed on and protruding from the other connecting end of the connecting conductor, being parallel to the second conductor and having a first end connected to the connecting end of the connecting conductor; and a second end; and a second signal point formed on the second end of the third conductor;

a coupling member mounted on the front surface of the dielectric substrate and connected to and protruding from the second signal point;

a ground plane being rectangular, mounted on the rear surface of the dielectric substrate and having four edges, four corners and two extension conductors being L-shaped, formed on and protruding from one edge of the ground plane, extending respectively along adjacent corners and being symmetrical relative to a symmetrical line along which the coupling member lies;

a support mounted perpendicularly on the front surface of the dielectric substrate, connected to the first signal point of the feeding member and having a rear end mounted on front surface of the dielectric substrate; and a front end; and a radiating patch mounted on the front end of the support and connected to the feeding member through the support.

2. The circularly polarized antenna as claimed in claim 1, wherein the radiating patch is rectangular.

3. The circularly polarized antenna as claimed in claim 2, wherein the ground plane entirely overlaps the feeding member and the feeding member is surrounded and enclosed by an outline of the ground plane.

4. The circularly polarized antenna as claimed in claim 3, wherein the length of the third conductor is larger than the length of the second conductor to generate a current phase difference.

5. The circularly polarized antenna as claimed in claim 4, wherein each extension conductor has a connecting end connected to the ground plane and located adjacent to the coupling member.

6. The circularly polarized antenna as claimed in claim 5, wherein the dielectric substrate is made of microwave dielectric.

7. The circularly polarized antenna as claimed in claim 6, wherein the second conductor is formed on and protrudes longitudinally and directly from the proximal end of the first conductor and the first end of the first signal conductor is connected directly to the proximal end of the first conductor.

8. The circularly polarized antenna as claimed in claim 6, wherein:

the feeding member is a Wilkinson power divider and further has a looped conductor and a resistor;

the second conductor is connected to the first conductor through the looped conductor;

the resistor is mounted on the looped conductor between the second conductor and the connecting conductor.

* * * * *